US007644761B1

(12) United States Patent
Gu et al.

(10) Patent No.: US 7,644,761 B1
(45) Date of Patent: Jan. 12, 2010

(54) FRACTURING METHOD FOR SUBTERRANEAN RESERVOIRS

(75) Inventors: Hongren Gu, Sugar Land, TX (US); J. Ernest Brown, Cambridge (GB); Fakuen F. Chang, Al-Khobar (SA)

(73) Assignee: Schlumberger Technology Corporation, Cambridge, MA (US)

( * ) Notice: Subject to any disclaimer, the term of this patent is extended or adjusted under 35 U.S.C. 154(b) by 0 days.

(21) Appl. No.: 12/172,413

(22) Filed: Jul. 14, 2008

(51) Int. Cl.
*E21B 43/267* (2006.01)

(52) U.S. Cl. ..... 166/280.1; 166/307; 166/308.1

(58) Field of Classification Search ..... None
See application file for complete search history.

(56) References Cited

U.S. PATENT DOCUMENTS

| | | | | |
|---|---|---|---|---|
| 2,970,645 | A | 2/1961 | Glass | |
| 4,249,609 | A * | 2/1981 | Haafkens et al. | 166/308.2 |
| 4,509,598 | A * | 4/1985 | Earl et al. | 166/308.2 |
| 4,718,490 | A | 1/1988 | Uhri | |
| 4,867,241 | A | 9/1989 | Strubhar | |
| 4,883,124 | A | 11/1989 | Jennings, Jr. | |
| 4,917,185 | A | 4/1990 | Jennings, Jr. et al. | |
| 4,951,751 | A | 8/1990 | Jennings, Jr. | |
| 4,974,675 | A | 12/1990 | Austin et al. | |
| 4,977,961 | A | 12/1990 | Avasthi | |
| 5,161,618 | A | 11/1992 | Jones et al. | |
| 5,238,067 | A | 8/1993 | Jennings, Jr. | |
| 5,507,342 | A | 4/1996 | Copeland et al. | |
| 6,543,538 | B2 | 4/2003 | Tolman et al. | |
| 6,719,054 | B2 | 4/2004 | Cheng et al. | |
| 7,004,255 | B2 | 2/2006 | Boney | |
| 7,028,775 | B2 | 4/2006 | Fu et al. | |
| 7,148,184 | B2 | 12/2006 | Francini et al. | |
| 7,275,596 | B2 | 10/2007 | Willberg et al. | |
| 2003/0236174 | A1 * | 12/2003 | Fu et al. | 507/200 |
| 2006/0042797 | A1 * | 3/2006 | Fredd et al. | 166/282 |

* cited by examiner

*Primary Examiner*—Zakiya W. Bates
(74) *Attorney, Agent, or Firm*—Brigid M. Laffey; Jody Lynn DeStefanis; Dale Gaudier

(57) ABSTRACT

A method of creating multiple fractures in a well traversing a formation is described using pressurized fluids in a highly deviated or horizontal section of the well at a pressure above the fracturing pressure of the formation, wherein for creating a fracture the pressurized fluid is alternated between an acid fracturing fluid and a proppant loaded fluid, such that the proppant blocks the flow of pressurized fluid into a fracture created during a previous step of the method and the subsequently pressurized acid fracturing fluid creates a new fracture at a location along the highly deviated or horizontal section different from the location of the previously created fracture.

11 Claims, 6 Drawing Sheets

In a highly deviated openhole section use acid fracturing to create a fracture
41
When the fracture has grown to desired size, change fluid to proppant loaded fluid
42
Let the proppant solidify in the near-wellbore region of the fracture
43
Monitor for screenout and change fluid back to acid fracturing fluid
44
Repeat to create more fractures along the wellbore
45

FRACTURING METHOD FOR SUBTERRANEAN RESERVOIRS

FIELD OF THE INVENTION

The invention relates to subterranean reservoirs, particularly hydrocarbon reservoirs. More specifically, the invention pertains to methods of fracturing wells drilled as horizontal or highly deviated open holes into subterranean reservoirs, particularly carbonate reservoirs.

BACKGROUND

Hydrocarbons (oil, natural gas, etc.) are typically obtained from a subterranean geologic formation (i.e., a "reservoir") by drilling a well that penetrates the hydrocarbon-bearing formation. A typical well is drilled as a vertical well into the subsurface. However, in recent times drilling practice evolved to include drilling of highly deviated (from the vertical) or horizontal wells to improve the contact of the well with a specific formation layer or pay zone.

Prior to production, the well is completed with the installation of production facilities, such as casing, production pipes and pumps. The hydrocarbon industry distinguishes between two basic types of completion. One is referred to as "open hole" completion characterized by leaving the drilled well without a casing lowered into the well in the formation zone and without a consolidating sheath of cement squeezed into the space between the drilled formation and the casing. If, on the other hand, the well is completed with casing and cement in the formation zone, the completion is referred to as "cased hole".

In order for hydrocarbons to be "produced," that is, travel from the formation to the wellbore (and ultimately to the surface), there must be a sufficiently unimpeded flowpath from the formation to the wellbore. This flowpath is through the formation rock, e.g., solid carbonates or sandstones having pores of sufficient size, connectivity, and number to provide a conduit for the hydrocarbon to move through the formation.

One key parameter that influences the rate of production is the permeability of the formation along the flowpath that the hydrocarbon must travel to reach the wellbore. When a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity.

Hydraulic fracturing consists of injecting viscous fluids (usually shear thinning, non-Newtonian gels or emulsions) into a formation at such high pressures and rates that the reservoir rock fails and forms a plane, typically vertical, fracture (or fracture network) much like the fracture that extends through a wooden log as a wedge is driven into it.

Granular proppant material, such as sand, ceramic beads, or other materials, is generally injected with the later portion of the fracturing fluid to hold the fracture(s) open after the pressures are released. Increased flow capacity from the reservoir results from the more permeable flow path left between grains of the proppant material within the fracture(s).

In chemical stimulation treatments, flow capacity is improved by dissolving materials in the formation or otherwise changing formation properties. The acidizing fluid is disposed within a well drilled into the formation to be fractured. Sufficient pressure is applied to the acidizing fluid to cause the formation to break down with the resultant production of one or more fractures therein. An increase in permeability is effected by the fracture formed as well as by the chemical reaction of the acid within the formation.

In a variation of the method involving acidizing, the formation is first fractured. Thereafter, an acidizing fluid is injected into the formation at fracturing pressures to extend the created fracture. The acid functions to dissolve formation materials forming the walls of the fracture, thus increasing the width and permeability thereof.

Fracturing is a very well established method and described in an extensive body of literature. Among those seen as most relevant to the present invention are U.S. Pat. No. 2,970,645 issued to Glass, U.S. Pat. No. 4,718,490 issued to Uhri, U.S. Pat. No. 4,867,241 issued to Strubhar, U.S. Pat. No. 4,883,124 issued to Jennings, U.S. Pat. No. 4,917,185 issued to Jennings et al., U.S. Pat. No. 4,951,751 issued to Jennings, U.S. Pat. No. 4,974,675 issued to Austin et al., U.S. Pat. No. 4,977,961 issued to Avasthi, U.S. Pat. No. 5,161,618 issued to Jones et al., U.S. Pat. No. 5,238,067 issued to Jennings, U.S. Pat. No. 5,507,342 issued to Copeland et al., U.S. Pat. No. 6,543,538 issued to Tolman et al., U.S. Pat. No. 6,719,054 issued to Cheng et al., U.S. Pat. No. 7,004,255 issued to Boney, U.S. Pat. No. 7,028,775 issued to Fu et al., and U.S. Pat. No. 7,148,184 issued to Francini et al. These patents disclose fracturing methods, as well as acid and proppant compositions. In particular, the '645 and '067 patents relate to methods of creating multiple fractures.

In the view of the above referenced patents it is seen as an object of the present invention to provide novel methods of creating multiple fractures, particularly multiple fractures in highly deviated or horizontal wells with open hole completions.

SUMMARY OF INVENTION

According to a first aspect, this invention relates to a method of creating multiple fractures in a wellbore traversing a formation by providing pressurized fluids in a highly deviated or horizontal section of the wellbore at a pressure above the fracturing pressure of the formation, wherein for creating a fracture the pressurized fluid is alternated between an acid fracturing fluid and a proppant loaded fluid, such that the proppant blocks the flow of pressurized fluid into a fracture created during a previous step of the method and the subsequently pressurized acid fracturing fluid creates a new fracture at a location different from the location of the previously created fracture along the highly deviated or horizontal section.

Thus, the invention overcomes the difficulty of creating multiple fractures in a highly deviated well without zonal isolation. It can be applied to generate multiple fractures connected by the wellbore at multiple points along the wellbore.

The proppant is preferably used to block fluid transport at the entrance of the fracture. This near wellbore screenout is designed to block the fluid pathway into the fracture and thus to prevent further growth of the fracture.

When an acid fracture is created by the acid fluid, the treating pressure drops and only one acid fracture is sustained by the injection flow rate. When the proppant slurry is injected, a near wellbore screenout is created in the acid fracture and the treating pressure rises. The increased pressure initiates and propagates other fractures. By alternating injection stages of acid fluid and proppant slurry, multiple fractures can be thus created along the horizontal wellbore with continuous pumping and without zonal isolation.

The invention exploits the tendency of proppant slurry to cause a near well screenout of an existing fracture. However, when used in combination with acid fracturing a conductivity channel is formed filled with proppant in the near wellbore region of the acid fracture, and hence, providing flow communication between the acid fracture and the well for subsequent hydrocarbon production.

These and other aspects of the invention are described in greater detail below making reference to the following drawings.

DETAILED DESCRIPTION

Figure 1A:
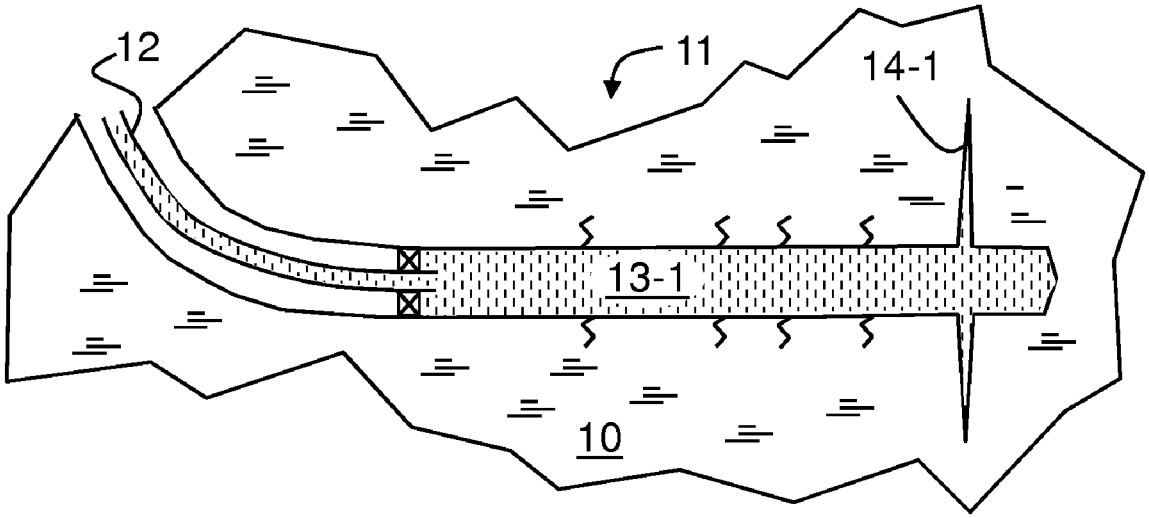
FIG. 1A shows a first acid fracturing stage of a fracturing operation in accordance with an example of the invention.

In the following, two examples of the present invention are described in greater detail. The first example includes the following steps and variants described while referring to the drawings as listed above.

In FIG. 1A, there is shown a single horizontal section 11 of a well in a formation 10 of carbonate rock. The section is completed as open hole with a pipe 12 providing a hydraulic connection to the surface equipment (not shown) including pumps and mixers as in a standard fracturing operation. At the stage of the operation shown in FIG. 1A, the section 11 is filled with an acid fracturing fluid 13-1 in direct contact with the wall of the formation 10. The treatment starts by pressurizing the acid fluid 13-1 at high pressure above the formation fracturing pressure FP (as shown in FIG. 1B) to create an acid fracture 14-1 at the location with the lowest in-situ stress or the weakest point along the well section 11.

Initially, more than one fracture may be created simultaneously in the acid fracturing process. However as the acid dissolves the carbonate rock at the fracture surface, the width of the dominant fracture 14-1 is enlarged and the fluid pressure drops. Thus even in case that more than one fracture is initially created, the subsequent drop in pressure (as shown in FIG. 1B) will cause most of the acid fluid 13-1 to be injected into the dominant fracture shown as fracture 14-1, which is the fracture that has the least resistance to fluid flow. When this occurs, other fractures are not sustained and only the dominant fracture is maintained by the injection flow rate.

Figure 1B:
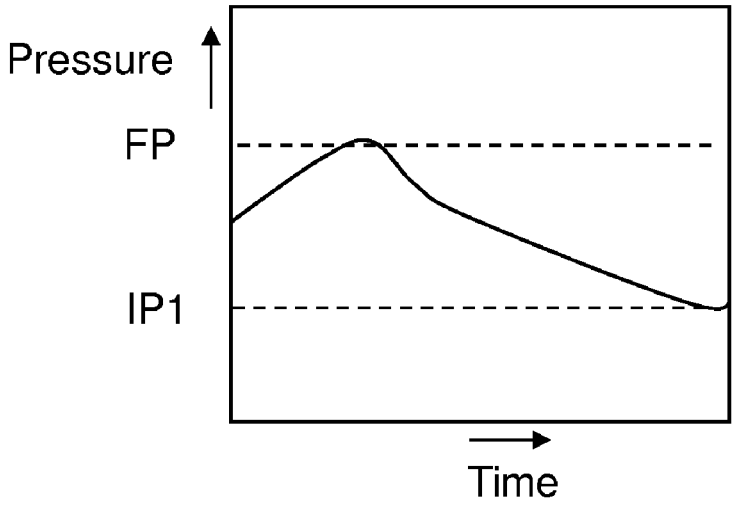
FIG. 1B shows a wellbore pressure profile at the stage of FIG. 1A.

After a dominant acid fracture is created and the pressure drops below a first Intervention Pressure IP1 as shown in FIG. 1B, the acid fluid 13-1 in the section 11 of the well is replaced by a slurry fluid 15-1 of a viscous carrier loaded with proppant or other particulate material comprising non-dissolvable and/or dissolvable solids as described in more detail below. As shown in FIG. 2 A, which shows an enlarged view of the fracture 14-1 created in the operation described above, the solidifying slurry of the slurry fluid 15-1 is designed to cause an at least partial blocking of the dominant fracture 14-1 near the wellbore 11. This at least partial blocking is referred to herein as "screenout". The slurry is designed to create such a screenout in the near wellbore region 16 of the already created acid fracture 14-1. The screenout shields the remainder of the fracture 14-1 from the pressure, In other words, the pressure drop across the screen or plug of solidifying proppant material ensures that any subsequent increase in pressure has a reduced effect on the existing fracture.

Figure 2A:
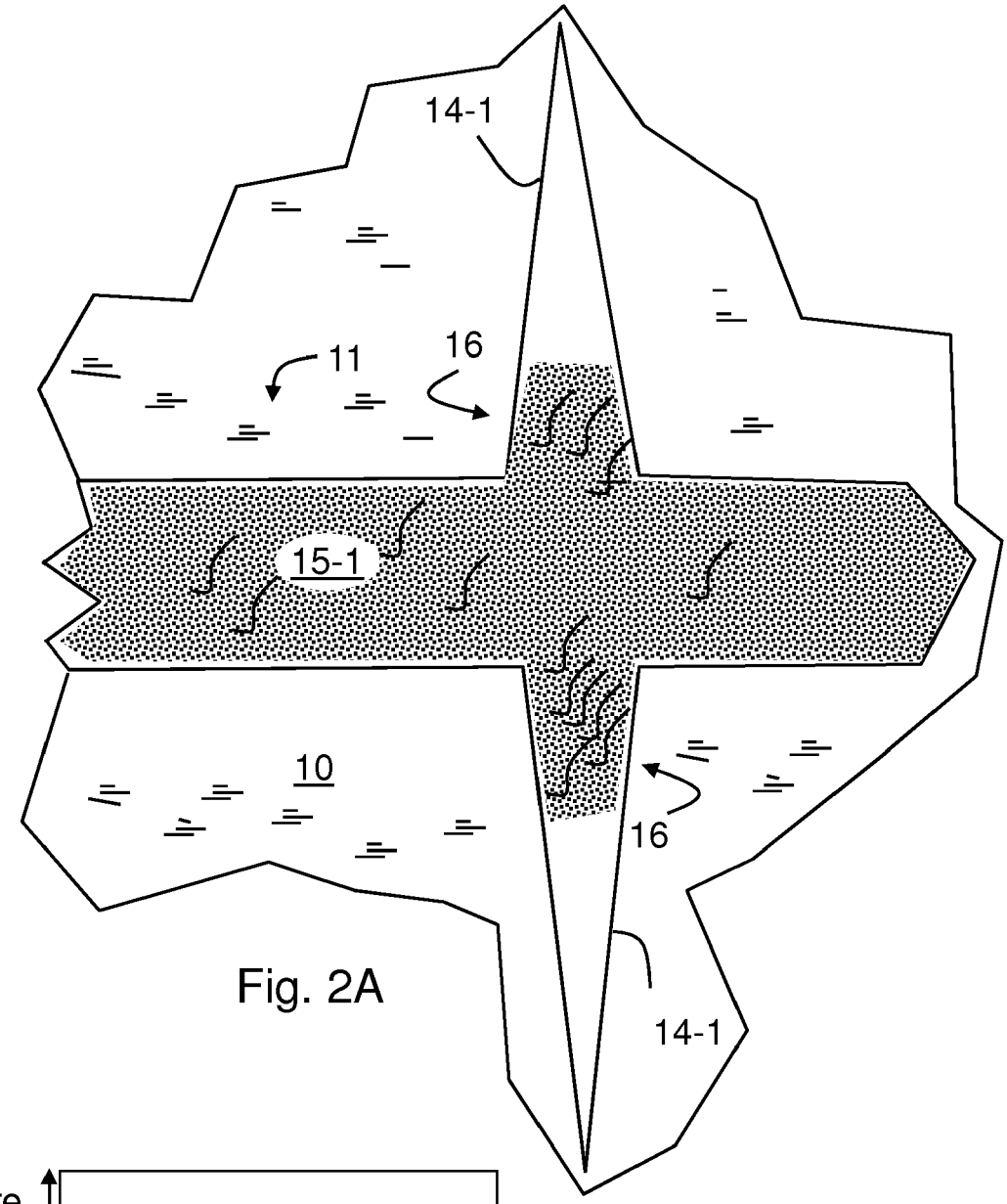
FIG. 2A shows a first proppant pumping stage of a fracturing operation in accordance with an example of the invention.
Figure 2B:
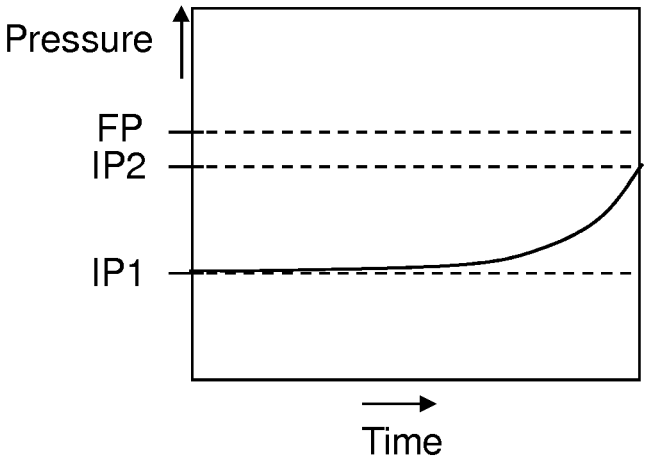
FIG. 2B shows a wellbore pressure profile at the stage of FIG. 2A.

The screenout will increase the flow resistance into the fracture 14-1 and hence the pressure of the fluid rises after the screenout as shown in FIG. 2B. The near wellbore screenout will not adversely affect the created acid fracture. The etched fracture length and conductivity of the acid fracture with proppant screenout should not be less than those of a regular acid fracture. The additional proppant in the near wellbore area of the acid fracture enhances the conductivity or the communication between the acid fracture and the wellbore compared with conventional acid fracturing.

If the channel or width in the near wellbore segment of an acid fracture is filled with proppant, the fracture will close on the proppant when the pumping pressure is removed after the fracturing treatment. The conductivity of this segment for hydrocarbon production will be provided by the propped width. In conventional acid fracturing, the channel is not filled with proppant, and the conductivity is provided by the residual etched width. Usually, an operator has more control on the propped width (by selecting the type and concentration of proppant) than on the etched width (which depends on the differential etching, rock inhomogeneity, rock embedment strength, etc.). Therefore, the above described combination of following the acid fracturing with a proppant fluid can achieve higher conductivity for a later production stage.

Figure 3A:
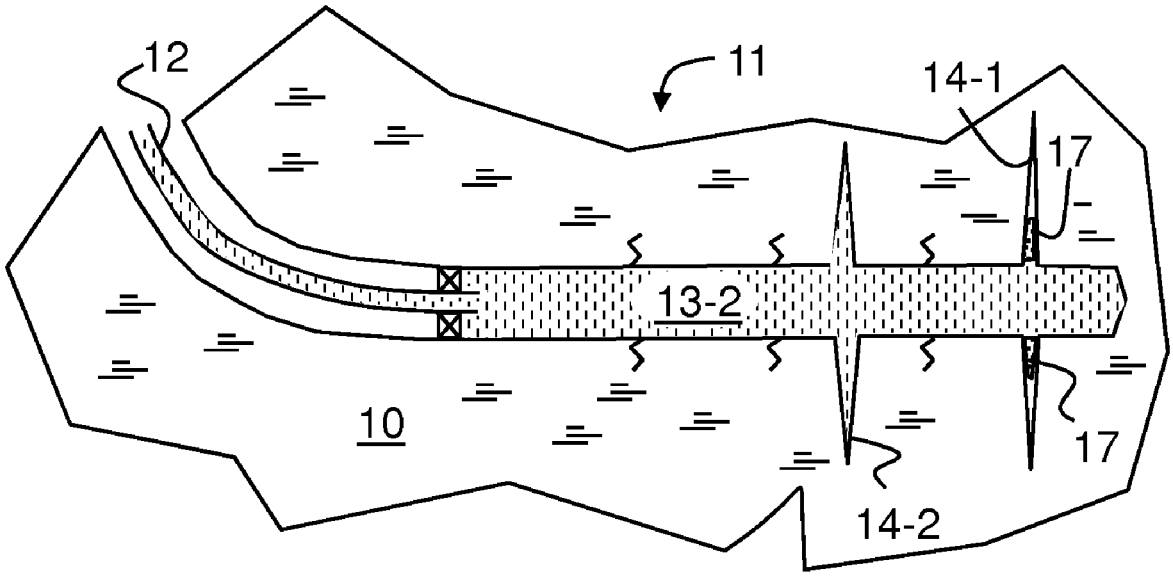
FIG. 3A shows a second pumping stage of a fracturing operation in accordance with an example of the invention.

When another pre-determined level of pressure, herein referred to second Intervention Pressure or IP2 as shown in FIG. 2B, is reached, the pressurized fluid is changed again to an acid fluid 13-2. The increased pressure will initiate and propagate a new dominant acid fracture 14-2 at a different location along the section 11 of the well. The first dominant fracture is at this stage blocked by the screen created by solidifications 17 of the proppant of the slurry 15-1 as pumped in the previous step. The new acid fracturing step, which can be seen as a repetition of the step illustrated above, is illustrated in FIG. 3A.

Figure 3B:
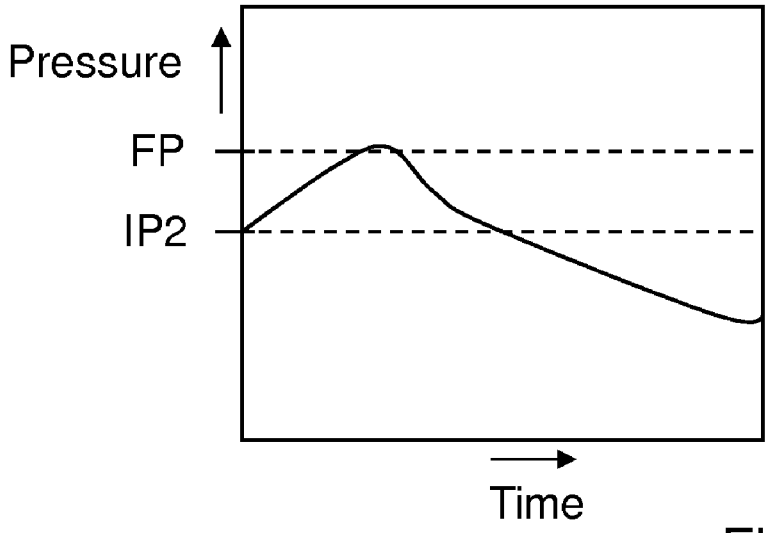
FIG. 3B shows a wellbore pressure profile at the stage of FIG. 3A.

In what can be regarded as a repetition of the process described above, carbonate rock at fracture surface is dissolved and the treating pressure drops as shown in FIG. 3B. Only a second dominant acid fracture 14-2 is sustained by the injected acid fluid 13-2. The second dominant acid fracture 14-2 is located along the wellbore section 11 but at a different location.

When this occurs, the proppant slurry is injected again to cause screenout in the second acid fracture 14-2 and pressure increases again in a manner illustrated already in FIGS. 2A and 2B above. This process can be repeated until a desired number of fractures are generated along the horizontal wellbore.

Figure 4:
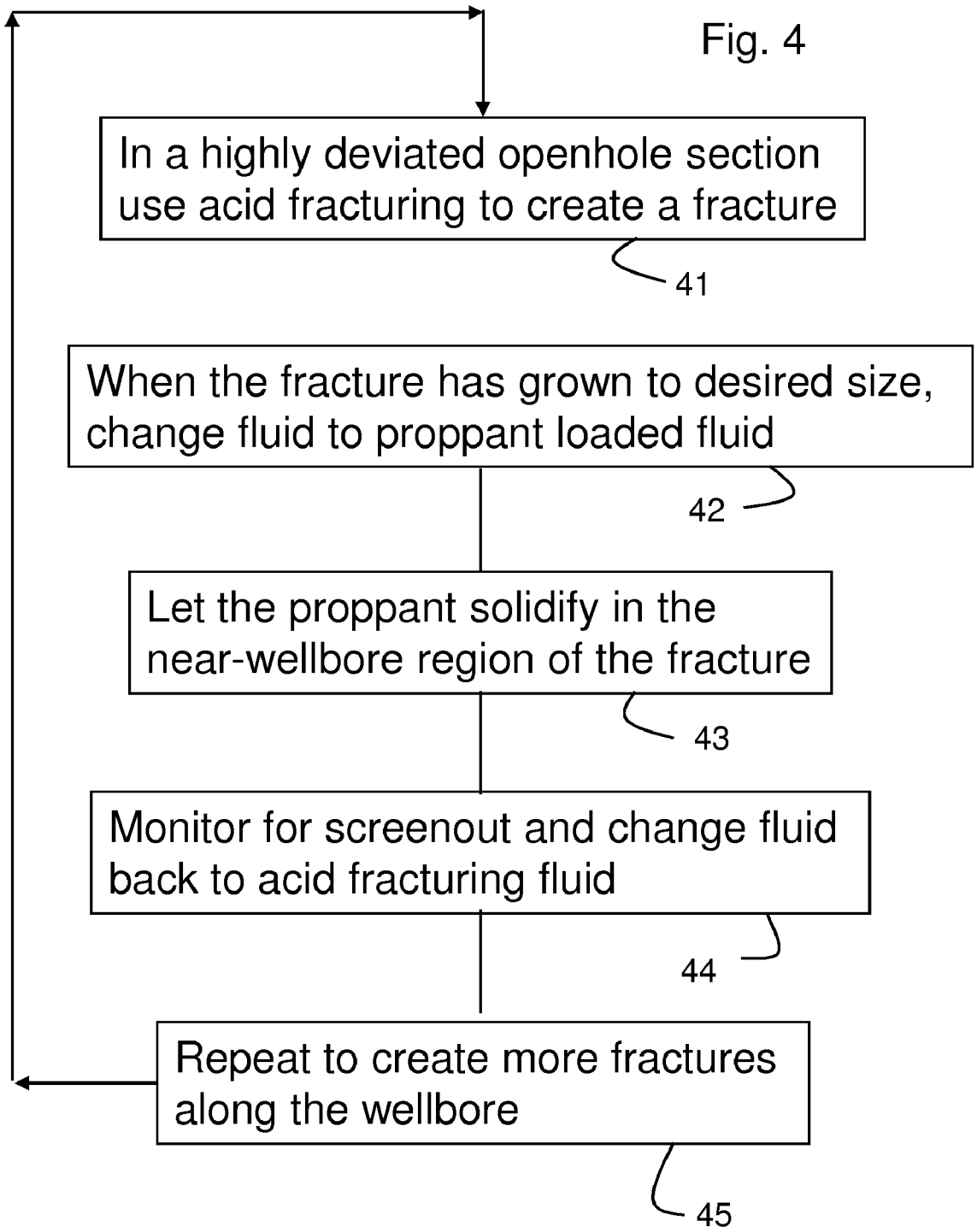
FIG. 4 is a flowchart illustrating steps in accordance with an example of the invention.

The method as described above is summarized in the flowchart of FIG. 4. The chart includes the step 41 of using acid fracturing to create a fracture in an highly deviated openhole section. According to step 42, when fracture has grown to desired size, the wellbore fluid is changed to proppant loaded fluid and in step 43 the proppant is allowed to solidify to from a near-wellbore screenout. If it is desired to create a further fracture along the wellbore, the wellbore fluid can be changed back into an acid fracturing fluid (step 44) and the process can be repeated 45.

The carrier fluid for the acid fracturing and the proppant can be selected from known carrier fluids. These known carrier fluids are typically varied depending on the well conditions encountered, but many if not most are aqueous based fluids that have been "viscosified" or thickened by the addition of a natural or synthetic polymer (cross-linked or uncross-linked). The carrier fluid is usually water or a brine (e.g., dilute aqueous solutions of sodium chloride and/or potassium chloride).

The viscosifying polymer is typically a solvatable (or hydratable) polysaccharide, such as a galactomannan gum, a glycomannan gum, or a cellulose derivative. Examples of such polymers include guar, hydroxypropyl guar, carboxymethyl guar, carboxymethylhydroxyethyl guar, hydroxyethyl cellulose, carboxymethyl-hydroxyethyl cellulose, hydroxypropyl cellulose, xanthan, polyacrylamides and other synthetic polymers. Of these, guar, hydroxypropyl guar and carboxymethlyhydroxyethyl guar are typically preferred based on commercial availability and cost/performance.

The dissolving agent in the acid fluid are typically acids such as hydrochloric acid, precursors or sources of hydrochloric acid, fluoric acid, precursors or sources of fluoric acid, mixture of hydrochloric acid and fluoric acid, mixture of sources of fluoric acid and hydrochloric acid, chelant, organic acid, etc. or combination thereof.

The blockage of a fracture and the required conductivity after clean-up can be achieved using known proppants. However proppant used without further additives may be in some cases not efficient at blocking the fractures. For example proppant may fill the entire etched fracture before it dehydrates and concentrates sufficiently to form a plug. However, for the purpose of later production of the well, it is advantageous to have the slurry bridge and screenout in the near wellbore region of the fracture rather than filling the entire fracture with proppant. To accomplish this, bridging or cementing agents can be added to the proppant to enhance the bridging process.

Following the teaching of U.S. Pat. No. 7,004,255, materials of different grades or dimensions can be applied either without or in combination with fibrous material. Besides sand other materials such as barite, fly ash, fumed silica, other crystalline or amorphous silicas, talc, mica, ceramic beads, carbonates, or taconite can be used. Any materials that will retain their particle size and shape during and after placement and that will not cause the placement fluid to fail are acceptable. However, the material are advantageously selected so as to not interfere with the viscosifying chemicals if the carrier fluid is viscosified and so as to be insoluble in the carrier fluid or in fluids whose flow they are intended to impede or prevent.

In a variant of the example, a malleable material can be used as some or all, preferably all, of the coarse particles. The malleable product further reduces the porosity when the fracture closes. Examples of these materials are walnut shells, aluminum pellets, and polymer beads. Although the particles of the plugging material are normally inert, they may also interact with one another chemically. For example, they may be advantageously coated with resin or a similar coating so that the particles stick together when heated. The particles may also include compositions that would react to form a cement.

Suitable fibers can for example be selected from those described in the U.S. Pat. No. 7,275,596 to Willberg et al. Following the teaching of that patent, suitable fibers include fibers from substituted and unsubstituted lactide, glycolide, polylactic acid, polyglycolic acid, copolymers of polylactic acid and polyglycolic acid, copolymers of glycolic acid with other hydroxy-, carboxylic acid-, or hydroxycarboxylic acid-containing moieties, and copolymers of lactic acid with other hydroxy-, carboxylic acid-, or hydroxycarboxylic acid-containing moieties, and mixtures of those materials.

The preferred fibers as described in above patent have a length of about 2 to about 25 mm, more preferably about 3 to about 18 mm. Typically, the fibers have a denier of about 0.1 to about 20, preferably about 0.15 to about 6. The fibers degrade at formation temperature in a time between about 4 hours and 100 days leaving a more porous screen at each fracture.

Though it is envisaged that the acid fracturing fluid and the proppant fluid are the same at each of the repeated stages described above, there may be circumstances in which it is more beneficial to vary the composition of these respective fluids.

During the treatment as described in the above example, continuous pumping is maintained and no zonal isolation between the locations of the fractures is required. During the pumping treatment, the pumping switches between pad fluid, acid fluid and proppant using different feeding containers.

It is advantageous to control the process through an automated control system. Such a system can be used to determine the treatment design parameters to achieve the required fracture geometry, conductivity. Using for example the pressure curve or the intervention pressures, FP, IP1 and IP2, such a control system can also determine the moment when a screenout occurs and how much pressure increase can be achieved. The system can further determine the required pump rate and fluid volumes for the alternating pumping stages of acid fluid and proppant slurry.

If it is desired to improve the control on the positioning of the fractures, it is possible to weaken the rock around the well at such desired locations. The weakening can be effected in a variety of ways including localized drilling using the same tools as are used for side-core drilling, by jet drilling from (for example) coiled tubing, or through the use of perforation charges.

A further variant of the invention is illustrated in FIG. 5 showing again a section 51 of a well. In this variant, a coiled tubing 52 is suspended from the surface into the section 51. The acid fluid 53 and proppant slurry 55 are delivered to the desired location by injecting the acid fluid 53 through the coiled tubing 52 and the proppant slurry 55 through the annulus between the coiled tubing and the well. The acid fluid 53 and the proppant fluid 55, respectively, can be selected from those described when referring to the first detailed example above.

Figure 5:
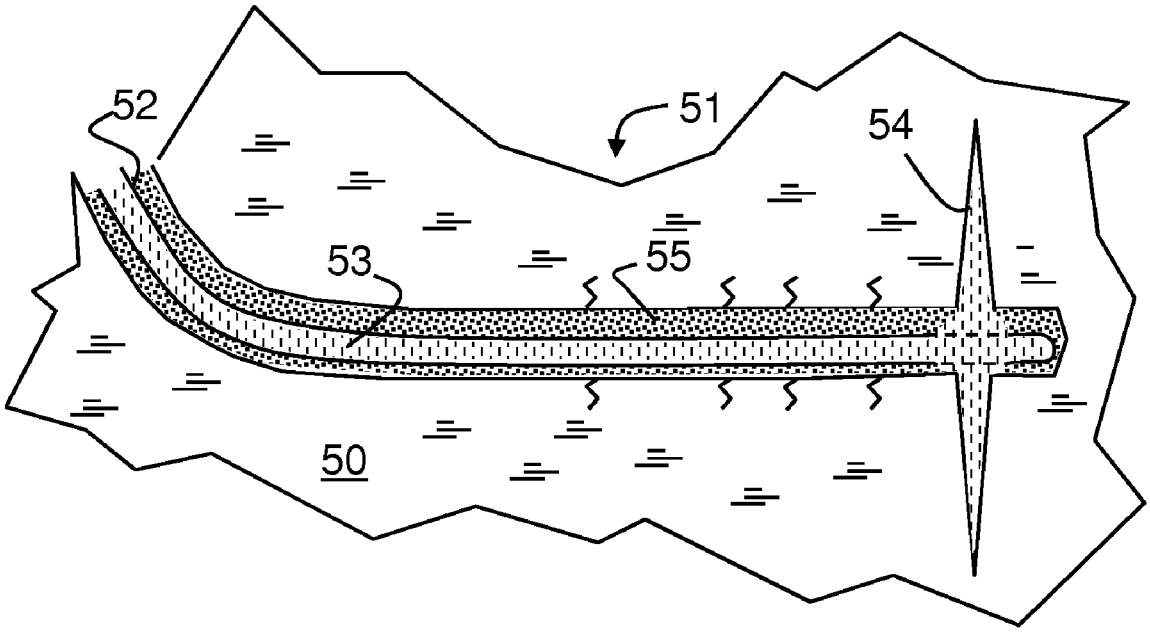
FIG. 5 shows a variant of an example of the invention using coiled tubing.
Figure 6:
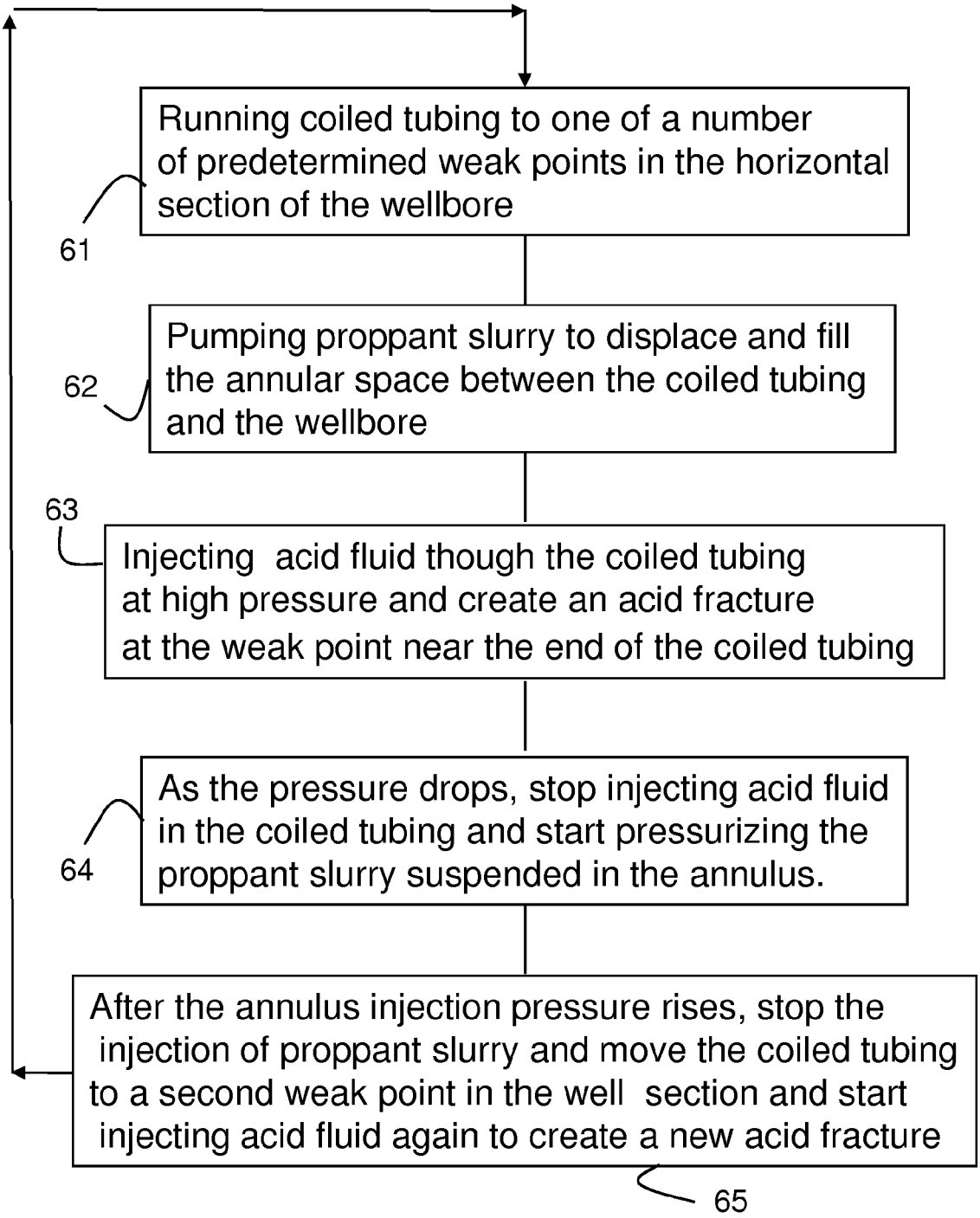
FIG. 6 is a flowchart illustrating steps in accordance with another example of the invention.

The details of the example include the following steps also shown in the flowchart of FIG. 6:

In step 61 the coiled tubing 52 of FIG. 5 is pushed to one of a number of predetermined weak points in the horizontal section of the well. The weak points can be naturally occurring such as low in stress or weakness introduced through the drilling of the section 51, or artificially introduced as described above.

In step 62 the proppant slurry 55 is used for displacing and filling the annular space between the coiled tubing and the wellbore with a proppant slurry 55.

During step 63 acid fluid 53 is injected though the coiled tubing at high pressure and creates an acid fracture 54 at the weak point near the end of the coiled tubing. Other acid fractures could be created initially, but due to the nature of acid fracturing, the treating pressure will soon drop and only one dominant fracture is sustained by the injection flow rate.

As the pressure drops, the injection of acid fluid 53 in the coiled tubing 52 is stopped in step 64 and the proppant slurry 55 suspended in the annulus is pressurized. The proppant slurry 55 causes near to the well screenout in the acid fracture, and the injection pressure rises as described when referring to FIG. 2 of the first detailed example above.

After the annulus injection pressure rises, the injection of proppant slurry 55 is stopped in step 65. The coiled tubing 52 is then moved to a second weak point in the well section 51 and injecting acid fluid 53 is started again to create a second acid fracture. The above steps can be repeated until the desired number of fractures is created along the horizontal wellbore.

After the last fracture has been created, the annulus is displaced with clean fluid after the last fracture is created, and the coiled tubing is pulled out of the well.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative processes, one skilled in the art will recognize that the system may be embodied using a variety of specific procedures and equipment and could be performed to evaluate widely different types of applications. Accordingly, the invention should not be viewed as limited except by the scope of the appended claims.

What is claimed is:

1. A method of creating multiple fractures in a well traversing a formation by providing a pressurized fluid in a highly deviated or horizontal section of the well at a pressure above the fracturing pressure of the formation, wherein for creating a fracture the pressurized fluid is alternated between an acid fracturing fluid and a proppant loaded fluid, such that the proppant blocks the flow of pressurized fluid into a fracture created using acid fracturing fluid during a previous step of the method and the subsequently pressurized acid fracturing fluid creates a new fracture at a location different from the location of the previously created fracture along the highly deviated or horizontal section.

2. The method in accordance with claim 1, wherein pressure is monitored during injection of the proppant loaded fluid and at a first predetermined pressure level the pressurized fluid is changed to the acid fracturing fluid.

3. The method in accordance with claim 1, wherein the pressure is monitored during injection of the acid fracturing fluid and the pressurized fluid is changed to the proppant loaded fluid at a second predetermined pressure level.

4. The method in accordance with claim 1, wherein proppant is chosen to bridge a fracture near the well.

5. The method in accordance with claim 1, wherein proppant loaded fluid comprises proppants of different sizes.

6. The method in accordance with claim 1, wherein proppant loaded fluid comprises fibrous materials.

7. The method in accordance with claim 1, wherein proppant loaded fluid comprises larger particles and/or fibers made of a material which dissolves breaks or degrades under downhole conditions or in the presence of acid.

8. The method in accordance with claim 1, further comprising the step of initiating fractures at several locations in the section.

9. The method in accordance with claim 1, further comprising the step of initiating fractures at several locations in the section by weakening the rock at said locations.

10. The method in accordance with claim 1, further comprising the step of initiating fractures at several locations in the section by weakening the rock at said locations using, drilling, perforating or jetting techniques applied to the wall of the formation.

11. The method in accordance with claim 1, wherein the locations are not hydraulically isolated from each other during the creation of the fractures.

* * * * *